United States Patent [19]

Schneider

[11] Patent Number: 4,706,747

[45] Date of Patent: Nov. 17, 1987

[54] CEMENTING PLUG

[75] Inventor: David E. Schneider, Houston, Tex.

[73] Assignee: Weatherford U.S., Inc., Houston, Tex.

[21] Appl. No.: 801,521

[22] Filed: Nov. 25, 1985

[51] Int. Cl.[4] ..... E21B 33/16

[52] U.S. Cl. ..... 166/153; 166/202

[58] Field of Search ..... 166/153–157, 166/170, 171, 177, 192, 193, 194, 291, 202; 15/104.6 R

[56] References Cited

U.S. PATENT DOCUMENTS

| | | | |
|---|---|---|---|
| 1,872,855 | 8/1932 | Walker | 166/153 X |
| 2,630,179 | 3/1953 | Brown | 166/155 X |
| 2,717,645 | 9/1955 | Schnitter | 166/156 |
| 2,740,480 | 4/1956 | Cox | 166/153 X |
| 3,006,415 | 10/1961 | Burns et al. | 166/156 |
| 3,145,778 | 8/1964 | Grekel et al. | 166/157 |
| 3,153,451 | 10/1964 | Chancellor et al. | 166/51 |
| 3,835,889 | 9/1974 | Hyde | 166/202 X |
| 3,842,905 | 10/1974 | Morrisett et al. | 166/155 |
| 3,948,322 | 4/1976 | Baker | 166/289 |
| 4,078,810 | 3/1978 | Arendt | 166/153 X |
| 4,262,702 | 4/1981 | Streich | 166/192 X |
| 4,378,838 | 4/1983 | Ogden et al. | 166/153 |
| 4,429,746 | 2/1984 | Allard | 166/156 X |
| 4,491,178 | 1/1985 | Terrell et al. | 166/202 X |

OTHER PUBLICATIONS

American Petroleum Institute, "Oil Well Cementing Practices in the United States", p.112 (1959).

Dowell Schlumberger, "Primary Placement Techniques", Chapter 10, pp. 1–20 (1984).

*Primary Examiner*—Stephen J. Novosad

*Assistant Examiner*—David J. Bagnell

*Attorney, Agent, or Firm*—Vaden, Eickenroht, Thompson & Boulware

[57] ABSTRACT

A wellbore plug having a wiper disposed in inverted position which, in one embodiment, reinforces a conventionally disposed wiper of the plug. A plug wiper is provided which has a conventional cone-shaped portion and an opposing reinforcing portion, cone-shaped or otherwise. A plug wiper is provided which has no threads for mating with other parts of the plug, but which has a hollow recess for emplacing the wiper on a plug shaft.

3 Claims, 14 Drawing Figures

Fig. 1
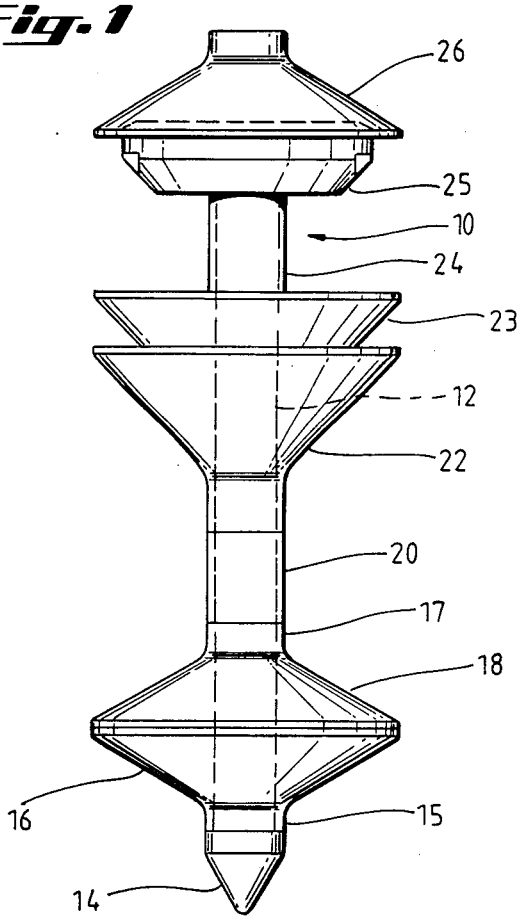
Fig. 2
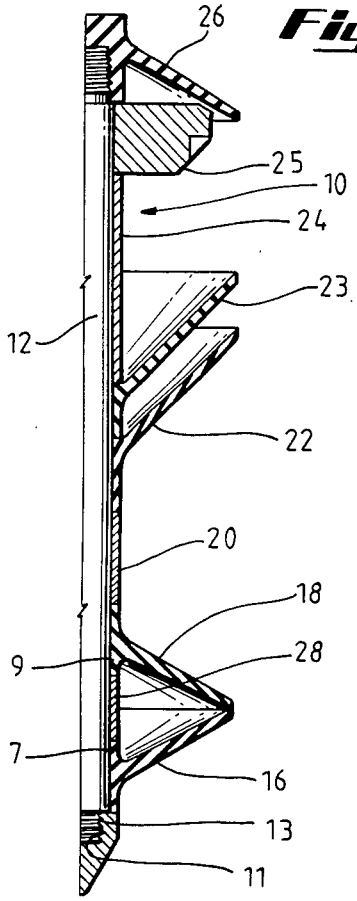
Fig. 3
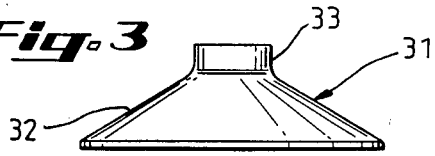
Fig. 4
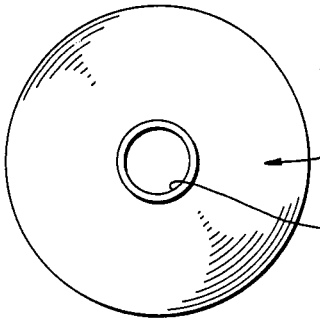
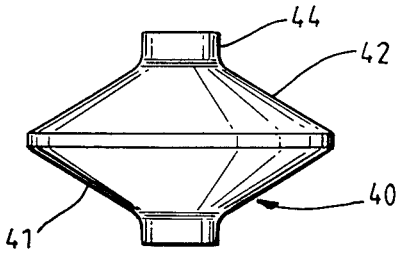
Fig. 5
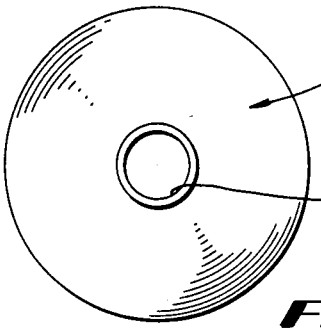
Fig. 6

CEMENTING PLUG

BACKGROUND OF THE INVENTION

1. Field of the Invention

This invention relates to rigid and flexible plugs for use in wellbores and particularly to plugs for use in cementing operations and cementation preparation operations in cased wellbores.

2. Prior Art

Plugs are used for various purposes in wellbores and in wellbore operations In cementing operations, plugs with flexible wipers are used to act as a barrier between cement and displacement fluid to prevent fluid/cement intermingling; to wipe off fluid such as drilling mud or cement from the interior casing wall; to provide means for indicating when cement has been displaced from within the casing; and to permit passage of the plug through portions of the casing string which are impassable to rigid plugs.

The available plugs have proven to be unsatisfactory. The flexible wipers must be flexible enough to pass through restrictions in the casing string. Plugs that exhibit such flexibility are not rigid enough to provide adequate wiping action. Also the flexible wipers deteriorate, disintegrate, and crack under normal operating conditions. Damaged wipers cause a plug to be off center thereby preventing the accurate and effective seating of the plug end. Failure of the plug to seal results in unwanted intermingling of wellbore fluids and cements and can make it impossible to engage in secondary operations such as the operation of an inflatable packer or of a stage tool.

SUMMARY OF THE PRESENT INVENTION

The present invention is directed to an improved wellbore plug which overcomes the problems of prior art plugs in an efficient and unique manner. A plug according to the present invention has one or more flexible wipers which are flexible enough to pass through restrictions in the casing yet strong and rigid enough to provide adequate wiping action and to resist damage significantly more than previous plugs. The new flexible wipers have a dual cone shape with the bases of the dual cones opposed to each other. In this manner the wiper is reinforced at its edges and is still flexible. In one embodiment the dual cone wiper is effected by emplacing a conventional single cone wiper on a plug so that the cone's apex points toward the plug's nose and an identical cone wiper is emplaced in an inverted ocnfiguration adjacent the first wiper so that the cone's outer edges contact each other. In another embodiment the dual cone wiper is an integral single member with dual opposed conical surfaces. In yet another embodiment the wiper has a hollow cylindrical recess extending along its vertical axis rendering it emplaceable about a plug's central shaft. Another particular embodiment of the present invention is a plug having one or more cone wipers in an inverted position. The improvements herein for conical centralizing wipers are also applicable to conical pressure energized wipers.

It is therefore an object of the present invention to provide a new and efficient wellbore plug.

Another object of the present invention is the provision of a new and efficient plug for cementing operations.

Yet another object of the present invention is the provision of a plug having a cone wiper in a position inverted as compared to the usual position of such wipers.

Still another object of the present invention is the provision of a plug in which an inverted cone wiper is disposed adjacent a conventionally emplaced cone wiper.

A particular object of the present invention is the provision of such a plug in which the wipers have a hollow recess for emplacing the wipers on a plug shaft and a cylindrical hollow spacer member is used between the wipers on the shaft.

A further object of the present invention is the provision of a wiper which has dual opposed conical surfaces.

Another object of the present invention is the provision of a wiper which has no internal or external threads.

Yet another object of the present invention is the provision of a plug having a conventionally disposed wiper and an adjacent reinforcing portion whose shape differs from that of the wiper.

Still another object of the present invention is the provision of a plug wiper having two surfaces, one cone shaped and the other non-cone shaped.

To one of skill in this art who has the benefits of this invention's teachings, other and further objects, features and advantages will be clear from the following description of presently preferred embodiments of the invention given for the purposes of disclosure, and taken in conjunction with the accompanying drawings.

DESCRIPTION OF THE DRAWINGS

FIG. 1 is a side view of a plug according to the present invention, the dotted line indicating the plug's central shaft and the hollow openings of various items mounted about the shaft.

FIG. 2 is a partial view in cross section of the plug of FIG. 1.

FIG. 3 is a side view of a plug wiper according to the present invention.

FIG. 4 is a top view of the plug of FIG. 3.

FIG. 5 is a side view of a plug wiper according to the present invention.

FIG. 6 is a top view of the plug of FIG. 5.

DESCRIPTION OF THE PREFERRED EMBODIMENTS

Figure 7:
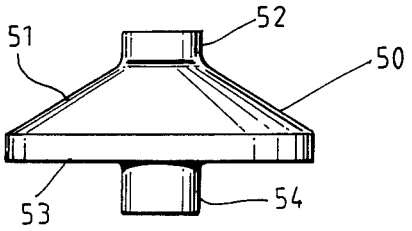
FIG. 7 is a side view of a plug wiper according to the present invention.

FIGS. 1 and 2 illustrate the pump down plug 10 for use in continuous cementing operations. The plug 10 has a shaft 12 to which is threadedly connected the nose 14. Two conical centralizing wipers 16, 18 are mounted on the shaft 12 behind the nose 14. The wiper 16 is disposed in the conventional manner with its apex 15 pointing in the same direction as the nose 14. The wiper 18 is disposed in inverted position as compared to the wiper 16 and with its apex 17 pointing toward the other end of the shaft 12, away from the nose 14.

A spacer sleeve 20 is mounted about the shaft 12 and maintains the space between the wiper 18 and a first pressure energizing wiper 22. Pressure energizing wipers 22 and 23 are mounted about the shaft. A spacer sleeve 24 maintains the space between the wiper 23 and a seal head 25. The seal head 25 is shaped so that it can be sealingly received in a seat disposed in the casing or in a tool such as a stage tool. The seal head 25 is mounted about the shaft 12. A conical centralizing wiper 26 is threadedly connected to the shaft 12 at the end opposite the nose 14.

FIG. 2 is a view of half of the plug of FIG. 1 in cross section. The half not shown mirrors the half which is shown. As illustrated in FIG. 2 the nose 14 has threads 11 which mate with threads 13 of the shaft 12. A spacer sleeve 28 is mounted about the shaft 12 to maintain a space between bases 7 and 9 of the wipers 16 and 18, respectively. The outer edges of the wipers 16 and 18 are in contact with each other. All of the spacers 28, 20, and 24 as well as the wipers 16, 18, 22, and 23 and the seal head 25 have openings therethrough as shown in FIG. 2 for receiving the shaft 12 for mounting about the shaft. The backward pitch of the pressure energizing wipers 22 and 23 is more pronounced than that of the centralizing wipers. It should be noted that it is within the scope of this invention to provide pressure energized wipers with the unique features described herein for centralizing wipers and for their disposition according to the present invention.

Figure 8:
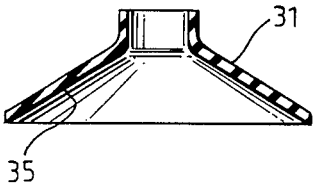
FIGS. 8, 9 and 10 are cross-sectional views of the wipers of FIGS. 3, 5 and 7, respectively.

FIGS. 3, 5, and 7 illustrate wipers according to the present invention. A wiper 31 of FIG. 3 has a conical surface 32 and an apex 33. As shown in FIG. 4 the conical surface 33 is generally perpendicular and an opening 34 is provided through the wiper 31 for mounting on a shaft. As shown in FIG. 8, it is preferred that the wiper 31 is not solid, having a recess 35 formed therein (although a solid wiper is within the scope of this invention).

Figure 9:
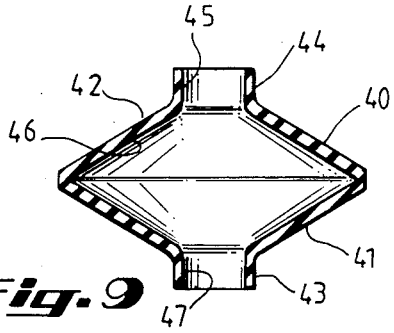

A wiper 40 shown in FIG. 5 has dual opposed conical surfaces 41 and 42 and apexes 43 and 44. As shown in FIG. 6 the apex 44 has an opening 45 therethrough which with an opening 47 in apex 43 renders the wiper 40 emplaceable on a shaft. As shown in FIG. 9 it is preferred that the wiper 40 is not solid, having a recess 46 therein (although a solid wiper would be within the scope of this invention).

Figure 10:
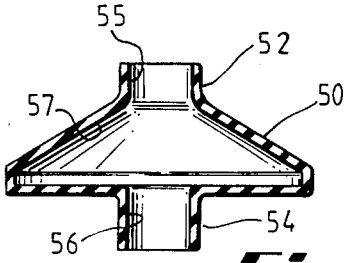

A wiper 50 shown in FIG. 7 has a conical member 51 with its apex 52 and a horizontal member 53 with its channel 54. As shown in FIG. 10 the apex 52 has an opening 55 and the channel 54 has an opening 56 for mounting the wiper 50 on a shaft. The wiper 50 has a recess 57 therein (although a solid wiper would be within the scope of this invention).

Figure 11:
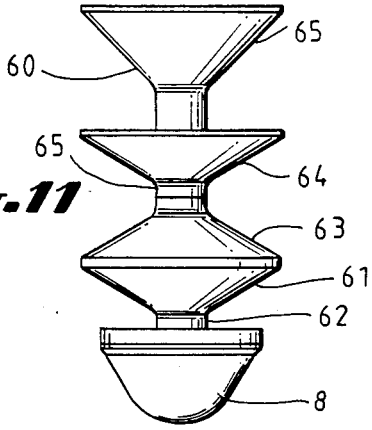
FIGS. 11, 12, 13 and 14 are side views of plugs according to the present invention.

FIGS. 11–14 illustrate variations of landing plugs according to the present invention. A nose 8 of each plug is configured to be received in and seat against a seat means disposed in casing such as a baffle or rubber seal-off plate. As shown in FIG. 11 a plug 60 has the conventional wiper 61 threadedly connected (as is conventional and is not shown in FIG. 11) to its nose 8 and disposed in the conventional manner with an apex 62 pointed toward the nose 8. A wiper 63 is threadedly connected to a threaded member which is in turn threadedly connected to the wiper 61 (this is conventional and not shown); but the inverted disposition of the wiper 63 with its outer edges in abutting contact with the outer edges of the wiper 61 is new. (As the outer edges of wipers 16 and 18 abut in FIGS. 1 and 2). A wiper 64 is disposed in the usual way with its apex 65 pointing toward the nose 8. The wiper 64 is threadedly connected to the wiper 63 (not shown) and a tail wiper 65 is threadedly connected to the wiper 64. There is no separate integral central shaft in the plug 60.

Figure 12:
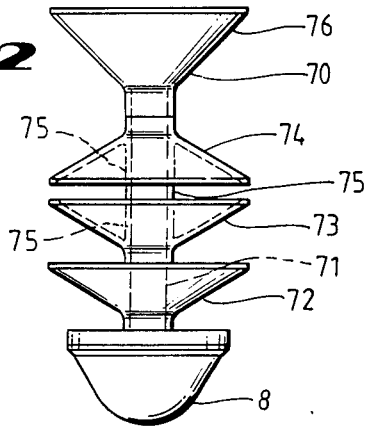

Similar to the shaft 12 of the plug 10 (FIG. 1) a plug 70 of FIG. 12 has a central shaft 71. Wipers 72, 73, 74 and a sleeve 75 have openings therethrough for emplacement on the shaft 71. A nose 8 and a tail wiper 76 are connected to the shaft 71 such as by threads (not shown). A wiper 74 is disposed in inverted relation to wiper 73.

Figure 13:
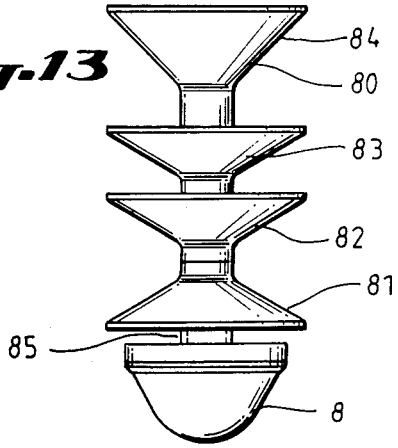
Figure 14:
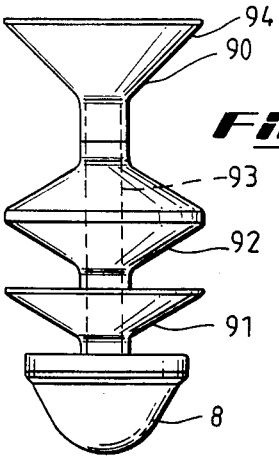

In the embodiment of FIG. 13, a plug 80 has a wiper 81 in inverted position and a spacer 85 spaces the wiper 81 apart from a nose 8 on a shaft (not shown). Wipers 82 and 83 are in the conventional configuration. plug 90 of FIG. 14 has the wiper 91 threadedly connected to nose 8. A shaft 93 is threadedly connected to a wiper 91 and to the tail wiper 94. A wiper 92 is similar to the wiper 40 (FIGS. 5, 6, 9) and has an opening therethrough for emplacement about the shaft 93.

In conclusion, therefore, it is seen that the present invention and the preferred embodiments disclosed herein is well adapted to carry out the objectives and obtain the ends set forth as well as other inherent therein. To one of skill in this art who has the benefit of this invention's teachings it will be clear that certain changes can be made in the various plugs and wipers disclosed herein without departing from the spirit of the invention and its scope as defined in the following claims.

I claim:

1. A plug for use in wellbore operations, the plug comprising a shaft having a first end and a second end, a nose threadedly connected to the first end of the shaft, a first hollow cup-shaped conical wiper, the wiper having an opening therethrough for receiving the shaft and mounting the first conical wiper on the shaft, the first conical wiper disposed on the shaft with its apex pointed in the same direction as the nose, a second hollow cup-shaped conical wiper having an opening therethrough for receiving the shaft and mounting the second conical wiper on the shaft, the second conical wiper disposed on the shaft with its apex pointed away from the nose, the outermost portion of the second conical wiper being in contact with the corresponding portion of the first conical wiper, a first spacer sleeve having a hollow opening therethrough for mounting the sleeve on the shaft, the spacer mounted on the shaft between the first conical wiper and the second conical wiper for maintaining the hollow openings of the conical wipers in spaced apart relation, one or more pressure energized wipers mounted on the shaft, a second spacer sleeve having a hollow opening therethrough for mounting the sleeve on the shaft, the spacer mounted on the shaft between the second conical wiper and the one or more pressure energized wipers for maintaining a space between the second conical wiper and the one or more pressure energized wipers, a seal head having a hollow opening therethrough for receiving the shaft and for mounting the seal head on the shaft, a third spacer sleeve having a hollow opening therethrough for mounting the sleeve on the shaft, the spacer mounted on the shaft between the seal head and the one or more pressure energized wipers for maintaining a space between the seal head and the one or more pressure energized wipers, a third conical wiper threadedly connected to the second end of the shaft and disposed with its apex pointing away from the nose, each of the first and second conical wipers having a recess formed therein which substantially conforms to the conical shape of the wiper, the recess rendering the interior of the first and second conical wipers substantially hollow.

2. A wiper for a wellbore plug, the plug having central shaft means, the wiper comprising body means, the body means having opening means therethrough for mounting the wiper on the plug's central shaft means, the body means having an extending portion thereof suitable for wiping the wellbore, and the body means having two hollow conical sub-members disposed in inverted contacting relation to each other with their outer edges in contact, the hollow conical sub-members having conical surfaces extending around the body means, the apexes of the two conical surfaces being in spaced apart relation and pointing away from each other, and the opening means extending from one apex to the other.

3. A plug for use in wellbore operations, the plug comprising shaft means having a first end and a second end, first hollow cup-shaped conical wiper means mounted on the shaft means with its apex pointed in the direction of the first end of the shaft means, second hollow cup-shaped conical wiper means disposed on the shaft means, the second conical wiper means inverted with respect to the first conical wiper means and the second hollow conical wiper means with its apex pointed away from the apex of the first hollow conical wiper means, and the outer edges of the first and second conical wiper means are in contact.

* * * * *